US005144749A

United States Patent [19]

Chen

[11] Patent Number: 5,144,749

[45] Date of Patent: Sep. 8, 1992

[54] UTILITY KNIFE

[76] Inventor: Chien-Tang Chen, No. 93, Hua Tan St., Hua Tan Hsiang, Changhua Hsien, Taiwan

[21] Appl. No.: 860,456

[22] Filed: Mar. 30, 1992

[51] Int. Cl.[5] ..... B26B 3/00

[52] U.S. Cl. ..... 30/319; 30/292; 30/307

[58] Field of Search ..... 30/319, 306, 307, 292, 30/299, 294, 293, 289

[56] References Cited

U.S. PATENT DOCUMENTS 1,358,973 11/1920 Minareik ..... 30/307
3,802,080 4/1974 Peter ..... 30/292
4,432,137 2/1984 Okada ..... 30/307
4,884,342 12/1989 McNamara et al. ..... 30/339
5,101,564 4/1992 Melter ..... 30/319

*Primary Examiner*—Frank T. Yost
*Assistant Examiner*—Hwei-Siu Payer
*Attorney, Agent, or Firm*—Poms, Smith, Lande & Rose

[57] ABSTRACT

A utility knife has a bolster formed at a downward angle from a body which receives a blade shield and a circular blade. A channel is formed in the body at the bolster and has an upper pair of notches and a lower pair of notches. The blade shield has a circular portion which has a diameter greater than that of the blade and a pair of resilient arms each with a tab. When the tabs are engaged with the lower pair of notches, the blade shield shields the blade, and when the tabs are engaged with the upper pair of notches, the blade is exposed.

1 Claim, 4 Drawing Sheets

UTILITY KNIFE

BACKGROUND OF THE INVENTION

The present invention relates to utility knives and, more particularly, to utility knives with a rolling blade.

One type of conventional utility knife has a blade slidably disposed in a housing, such that the blade is retracted into the housing when not in use to prevent accidents of the knife injuring a user. This type of knife is limited in application.

Another type of conventional utility knife has a rolling blade, which is able to perform further or different applications from the first. In order to protect a user from safety accidents, structure is provided to house the blade when not in use. But as of yet, a suitable structure has not been developed which insures that the blade will not accidentally cause harm to a user. Therefore, the present invention fills this need.

SUMMARY OF THE INVENTION

Accordingly, it is an object of the present invention to provide a utility knife with a structure which shields a rotatable blade in a secure manner.

It is another object of the present invention to provide a utility knife with a blade shield with engaging means which secure the blade shield in two positions; one position when the utility knife is not in use and one position when the knife is in use.

These and additional objects will become apparent to one skilled in the art upon reading the following detailed description with reference to the accompanying drawings.

DETAILED DESCRIPTION OF THE PREFERRED EMBODIMENT

Figure 1:
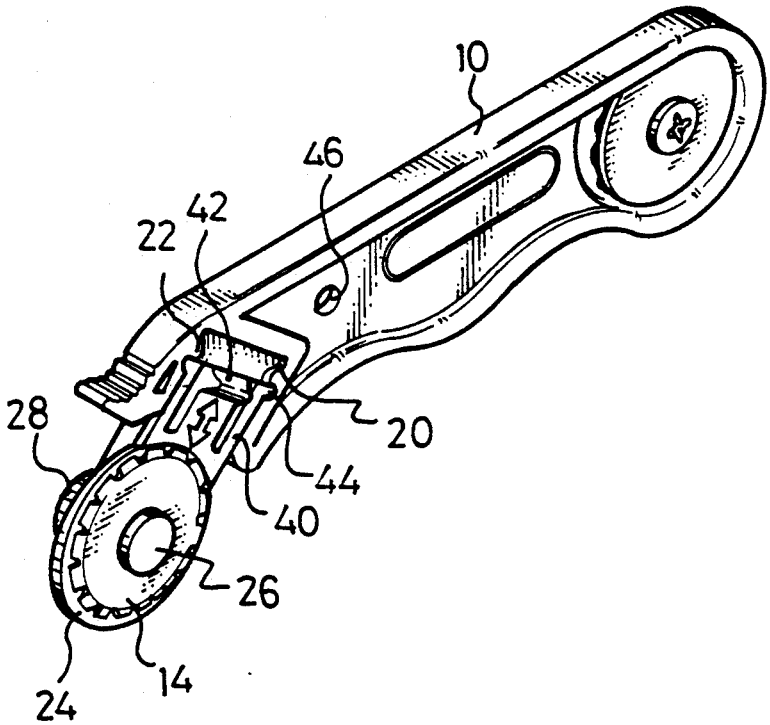
FIG. 1 is a perspective view of a utility knife shown in a preferred embodiment in accordance with the present invention.
Figure 2:
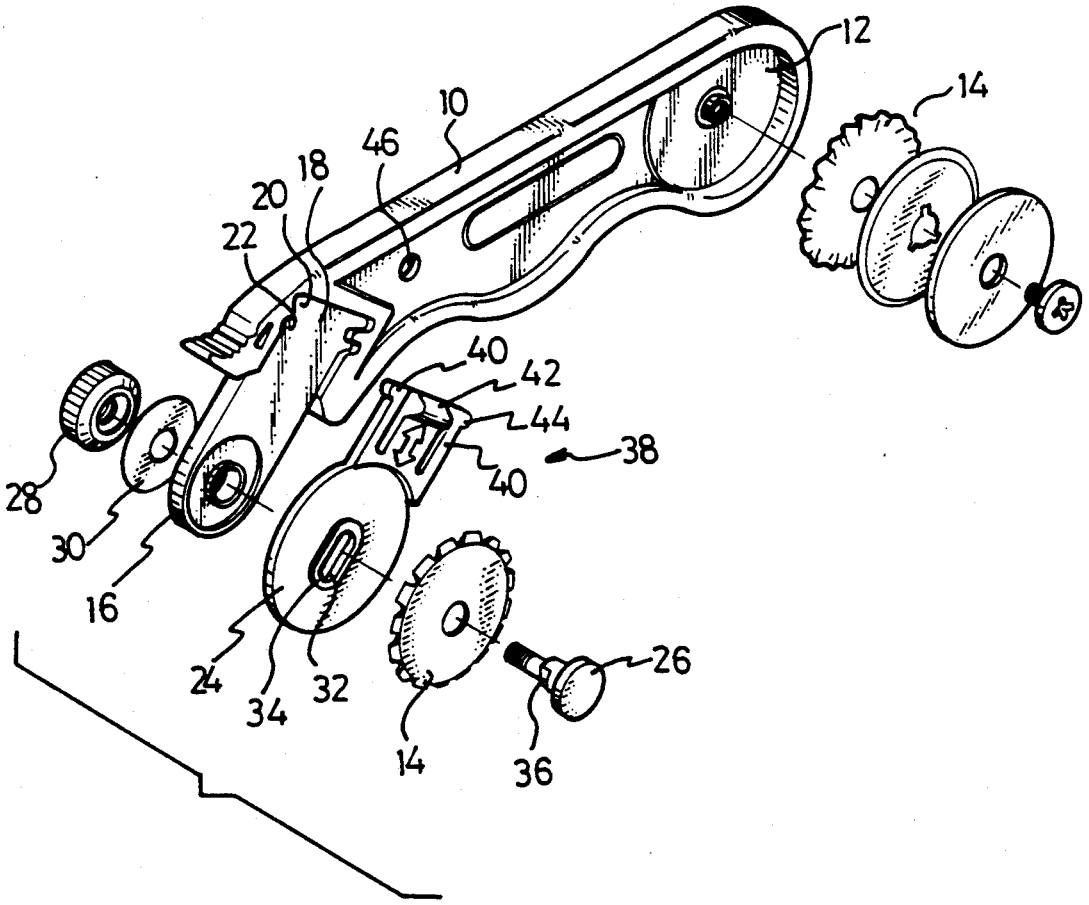
FIG. 2 is an exploded view of the utility knife.

Referring to FIGS. 1 and 2, a utility knife in accordance with the present invention is shown in a preferred embodiment. The utility knife generally comprises a body 10 which serves as a handle and has recess 12 formed in a rear portion thereof in which spare blades 14 are stored. On a front portion of the body 10 is formed a bolster 16 which extends at an angle downward from the general alignment of the body 10.

In the front portion of the body 10 is formed a channel 18 in which are formed two pairs of notches: an upper pair 20 and a lower pair 22, the upper pair of notches 20 being defined as the pair furthest from the end of the bolster 16. The channel 18 is configured so as to be aligned with the bolster 16.

A blade shield 24 and a blade 14 are attached to the bolster 16 through a hole formed therein and fastening means such as a screw 26, a nut 28, and a washer 30. The blade shield 24 has an oval slot 32 formed therein with flange 34 formed therearound. The diameter of the blade shield 24 is greater than that of the blade 14. The screw 26 has a shoulder portion 36 which is receivable in the slot 32 such that the blade shield 24 is slidable thereon while being retained thereby.

Figure 3:
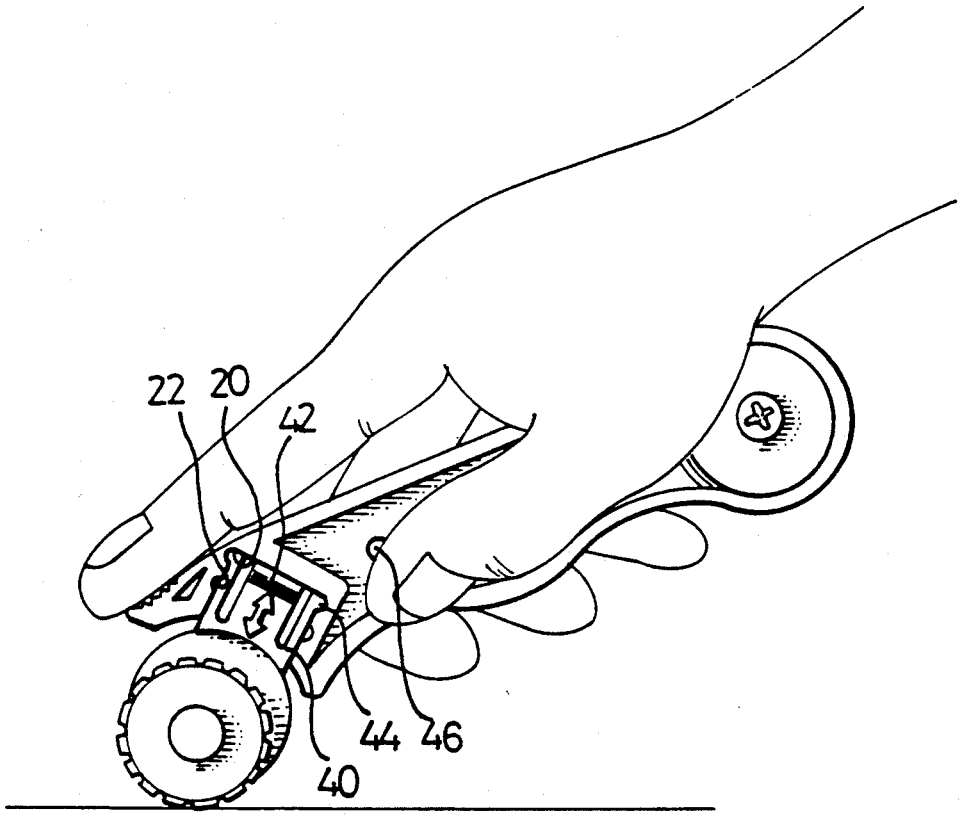
FIG. 3 is a side plan view of the utility knife in relation to a user in use.

Engaging means 38 is formed on the blade shield 24 for engaging with the pairs of notches 20 and 22. The engaging means 38 generally comprises a pair of resilient arms 40 and a projection 42. The engaging means 38 is slidably received in the channel 18. Each resilient arm 40 has a tab 44 formed on an end thereof which is engageable with the notches 20 and 22. Therefore, the tabs 44 engage with the notches 20 and 22 when a user exerts a small force on the projection 42 to urge the tabs 44 thereout and into the other This structure allows the blade shield 24 to be retained in a first position, as shown in FIG. 1, when the tabs 44 are engaged with the lower pair of notches 22, thereby shielding the blade 14; and a second position, as shown in FIG. 3, when the tabs 44 are engaged with the upper pair of notches 20, thereby allowing the blade 14 to cut.

Figure 4:
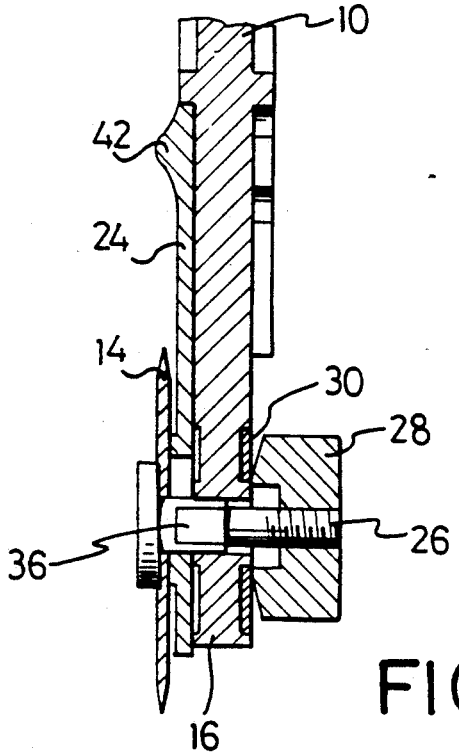
FIG. 4 is a cross-sectional view of a blade portion with corresponding structure of the utility knife.

FIG. 4 illustrates the symmetry of the bolster 16 such that the blade 14 and the blade shield 24 may be positioned on either side thereof so as to accommodate left-handed users as well as right-handed; that is, a channel 18 and notches 20 and 22 are formed on both sides of the bolster 16.

Figure 5:
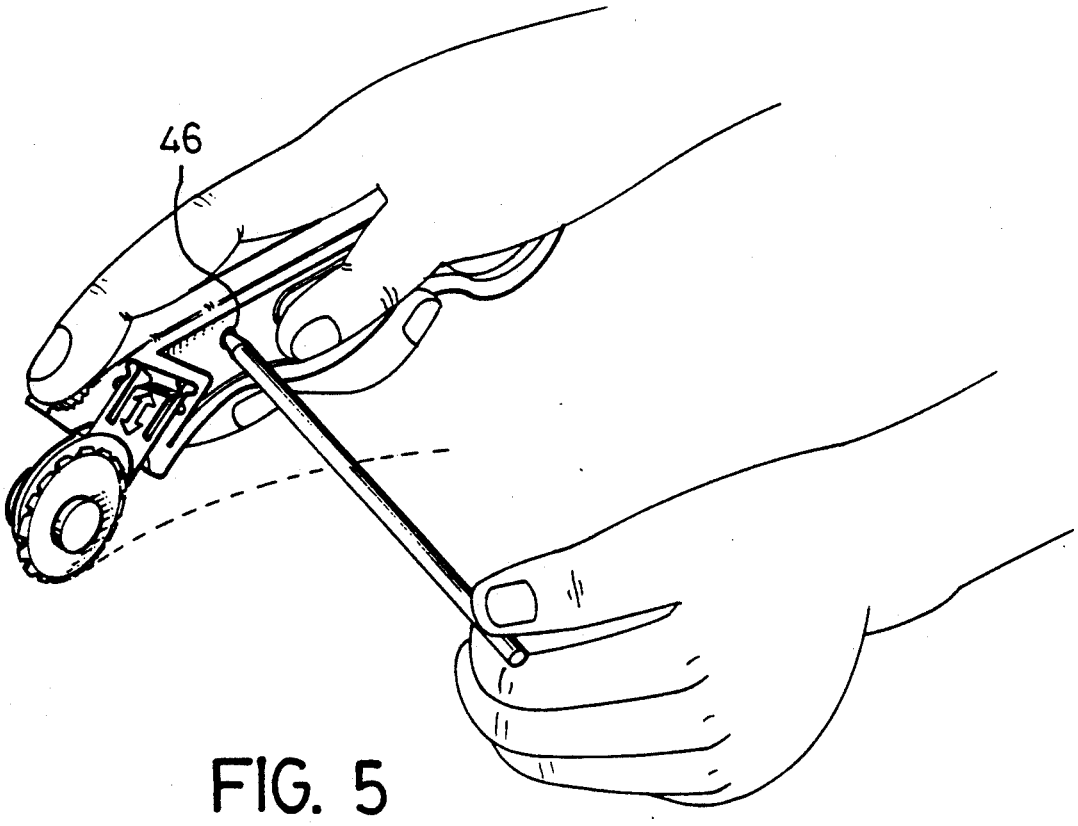
FIG. 5 is a perspective view of the utility knife shown in a possible working embodiment.

FIG. 5 shows a possible working embodiment of the utility knife where a compass hole 46 is formed in the body 10 so as to guide a user when cutting circles.

While a preferred embodiment has been described, further embodiments will become apparent to someone skilled in this and related art. All possible embodiments are intended to fall within the scope of this specification and as outlined in the following claims.

I claim:

1. A utility knife comprising:

a body which serves as a handle for manipulation;

a bolster protruding from a front portion of said body, extending at an angle downward therefrom;

a channel being formed in said front portion of said body and an angle corresponding to that of said bolster and having an upper pair of notches and a lower pair of notches formed therein, said upper pair of notches being defined as further away from an end of said bolster; and a blade shield comprising a substantially circular portion and engaging means, said circular porting having a slot formed therein, said engaging means being slidably received in said channel and comprising a pair of resilient arms each having a tab formed on an outside end thereof and a projection, said tabs being engageable with said notches; and a circular blade having a diameter smaller than that of said circular portion of said blade shield; fastening means such as a screw and a nut fastening said blade shield to said bolster in a slidable manner and fasten said blade to said bolster in a rotatable manner;

whereby when said utility knife is not in use, said tabs are engaged with said lower pair of notches, thereby said circular portion of said blade shield shields said blade; and when it is desired to use said utility knife, a user pushes on said projection, urging said tabs out of said lower pair of notches into said upper pair of notches, thereby moving said blade shield upward and exposing said blade.

* * * * *